US006354690B1

(12) United States Patent
Murakami

(10) Patent No.: US 6,354,690 B1
(45) Date of Patent: Mar. 12, 2002

(54) PRINTING DEVICE WITH TIMING PULSE GENERATOR

(75) Inventor: Atsushi Murakami, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/276,818

(22) Filed: Mar. 26, 1999

(30) Foreign Application Priority Data

Mar. 26, 1998 (JP) ..... 10-100696

(51) Int. Cl.[7] ..... B41J 23/00
(52) U.S. Cl. ..... 347/37; 347/14
(58) Field of Search ..... 347/14, 37

(56) References Cited

U.S. PATENT DOCUMENTS 5,170,416 A * 12/1992 Goetz et al. ..... 377/17
5,444,468 A 8/1995 Fukushima et al. ..... 347/14
5,521,620 A * 5/1996 Becerra et al. ..... 347/14
5,815,172 A * 9/1998 Moh ..... 347/14

FOREIGN PATENT DOCUMENTS

EP 0 945 277 A2 * 9/1999 ..... B41J/2/51
GB 2 316 513 A 2/1998 ..... B41J/2/045
JP A-9-136465 5/1997 ..... B41J/19/18

* cited by examiner

*Primary Examiner*—J E. Barlow
*Assistant Examiner*—Alfred E. Dudding
(74) *Attorney, Agent, or Firm*—Oliff & Berridge, PLC

(57) ABSTRACT

A timing pulse generator for a serial printer, which generator outputs a print timing pulse at a timing necessary for accurately controlling movement of the print head. In this timing pulse generator, an edge detection circuit outputs a pulse signal each time it detects the rising edge of an encoder signal output in response to movement of the carriage. A timer circuit measures the pulse period between two succeeding pulse signals output from the edge detection circuit. A first storage circuit outputs the stored previous pulse period and overwrites the storage area with this new pulse period. A second storage circuit outputs the stored pulse period immediately before the previous pulse period and overwrites the storage area with the previous pulse period output from the first storage circuit. A subtraction circuit calculates the difference between the previous pulse period and the pulse period immediately before the previous pulse period, after which an addition circuit adds this difference to the previous pulse period to obtain an estimated value or a pulse period equivalent to the current velocity of the carriage. Finally, the estimated value is divided by a prescribed value based on the printing resolution to generate the print timing pulse that provides the print head drive timing.

25 Claims, 4 Drawing Sheets

PRINTING DEVICE WITH TIMING PULSE GENERATOR

BACKGROUND OF THE INVENTION

1. Field of the Invention

The present invention relates to a timing pulse generator and particularly to a timing pulse generator in a printing device having a serial print head that moves in a scanning motion to perform a print operation, wherein the timing pulse generator provides a print timing based on the resolution of the printing device. The present invention also relates to printing device provided with such a timing pulse generator.

2. Description of the Prior Art

Conventional serial printers such as that proposed in Japanese Laid-Open Patent Publication HEI-9-136465 include an application specified integrated circuit (ASIC). In order to enable printing at a high resolution independent of CPU calculations, this ASIC calculates a pulse period from pulse signals that are generated based on the velocity of the carriage supporting the print head. Further, the ASIC generates a print timing pulse by dividing the calculated pulse period by a prescribed value corresponding to the printing resolution.

As shown in FIG. 5(A), this conventional device inputs the previous pulse period into the print timing generator circuit (multiplier circuit), which generates a print timing pulse by dividing the pulse period by the prescribed value.

As shown in FIG. 5(B), however, the pulse period corresponding to the velocity of the carriage in this type of serial printer is not uniform, due to speed variations caused by feedback control for the carriage drive motor. Also, when employing an open control carriage driving method, the velocity of the carriage varies subtly due to the effects of mechanical tolerances. As a result, it is not possible to generate an accurate timing pulse from the previous pulse period in this conventional method, due to variations in carriage velocity and the like. Accordingly, this conventional method causes errors in print timing, degrading the dot position accuracy in the carriage scanning direction. This is a particularly serious problem in high-accuracy printing and can result in poor color matching in color printing.

SUMMARY OF THE INVENTION

In view of the foregoing, it is an object of the present invention to provide a timing pulse generator capable of generating a highly accurate timing pulse that accounts for speed variations in the moving member; and a printing device provided with this type of timing pulse generator that is capable of performing good quality high-resolution printing.

These and other objects of the present invention will be attained by a timing pulse generator for generating timing pulses in association with movement of a moving, member that is driven to move at a velocity along a prescribed transport path, the timing pulse generator including: a pulse generating circuit that generates pulse signals corresponding to the velocity of the moving member; a timer circuit that sequentially measures pulse periods between two succeedingly occurring pulse signals generated by the pulse generating circuit; a storage circuit that stores a previous pulse period previously measured by the timer circuit and a pulse period immediately before the previous pulse period measured by the timer circuit immediately before the measurement of the previous pulse period; a pulse period estimating circuit that estimates a pulse period corresponding to a current velocity of the moving member based on the previous pulse period and the pulse period immediately before the previous pulse period; and a timing pulse generating circuit that generates timing pulses based on the pulse period estimated by the pulse period estimating circuit in order to provide timings for executing prescribed operations with the moving member.

With this construction, when the moving member is driven to move by a motor, the pulse generating circuit generates a pulse signal corresponding to the velocity of this moving member. The pulse period measuring circuit measures the pulse period corresponding to the velocity of the moving member based on the pulse signals generated by the pulse generating circuit. At least the previous pulse period and the pulse period immediately before the previous pulse period are stored in the first and second storage circuits, respectively. Based on variations in the past pulse periods stored in the first and second storage circuits, the pulse period estimating circuit estimates a pulse period corresponding to the current velocity of the moving member. In other words, the current velocity of the moving member is estimated to take into account variations in its speed based on variations in past pulse periods. Then, based on the pulse period estimated by the pulse period estimating circuit, the timing pulse generating circuit generates a timing pulse to provide a timing for executing prescribed operations with the moving member. Accordingly, it is possible to minimize errors in operation timing by anticipating control speed variations caused by feed back control and mechanical speed variations in open control and by controlling the timing of prescribed operations accordingly.

In the embodiment of the present invention, the pulse period estimating circuit includes a subtracting circuit that calculates a value by subtracting the pulse period immediately before the previous pulse period from the previous pulse period; and an adding circuit that adds the value calculated by the subtracting circuit to the previous pulse period stored in the first storage circuit to provide an estimated pulse period. The timing pulse generating circuit generates the timing pulse by dividing the estimated pulse period by a prescribed value.

With this construction, the subtracting circuit calculates a value corresponding to the degree of acceleration or deceleration of the moving member by subtracting the pulse period immediately before the previous pulse period from the previous pulse period. The adding circuit calculates an estimated pulse period to be measured next, that is, the pulse period corresponding to the current velocity of the moving member, by adding the calculated value corresponding to the degree of acceleration or deceleration of the moving member to the previous pulse period. Next, the timing pulse generating circuit generates a timing pulse by dividing the estimated pulse period calculated by the adding circuit by a prescribed value. As a result, it is possible to generate a timing pulse that appropriately estimates variations in the velocity of the moving member, enabling accurate timing of prescribed movements of the moving member.

According to another aspect of the present invention, there is provided a timing pulse generator that includes: an encoder element that outputs an encoder signal having a level varied according to an amount of movement by a moving member; an edge detection circuit that receives the encoder signal from the encoder element and outputs a pulse signal when an edge indicating a change in the level is detected; a timer circuit that outputs an accumulated counter value and resets and starts itself based on the pulse signal output by the edge detection circuit; a first storage circuit that outputs a currently stored counter value and resets itself based on the pulse signal output by the edge detection circuit and that overwrites storage contents with the counter value output from the timer circuit; a second storage circuit that outputs a currently stored counter value and resets itself based on the pulse signal output by the edge detection circuit and that overwrites storage contents with the counter value output from the first storage circuit; a subtraction circuit that receives as input the counter values output from the first storage circuit and the second storage circuit and that outputs a difference value calculated by subtracting the counter value output from the second storage circuit from the counter value output from the first storage circuit; an addition circuit that receives as input the difference value output from the subtraction circuit and the counter value output from the first storage circuit and that outputs a counter value calculated by adding these two values; and a timing pulse generating circuit that generates a timing pulse to apply a timing to the moving member in order to execute prescribed operations.

With this construction, when the motor drives the moving member to move, the encoder element outputs an encoder signal that changes according to the amount of movement. When the edge detection circuit detects a rising or falling edge of this encoder signal, the edge detection circuit outputs a pulse signal. This pulse signal functions as a reset signal for the timer circuit and first and second storage circuits. When a pulse signal from the edge detection circuit is input into the timer circuit, the timer circuit resets and starts over, outputting the counter value stored up to that point. This counter value, which signifies a pulse period corresponding to the velocity of the moving member, is input into the first storage circuit. Upon receiving a pulse signal from the edge detection circuit, the first storage circuit resets; outputs the stored counter value previously input from the timer circuit; and rewrites the storage area with the new counter value input from the timer circuit. In this way, the counter value output from the first storage circuit (equivalent to the previous pulse period) is input into the second storage circuit, subtraction circuit, and addition circuit. Upon receiving a pulse signal from the edge detection circuit, the second storage circuit resets; outputs the stored counter value previously input from the first storage circuit (equivalent to the pulse period immediately before the previous pulse period); and rewrites the storage area with the new counter value input from the first storage circuit. At this time, the counter value corresponding to the pulse period immediately before the previous pulse period that was output from the second storage circuit is input into the subtraction circuit.

Hence, each time the edge detection circuit generates a pulse signal, counters output from the first and second storage circuits and corresponding to the previous pulse period and the pulse period immediately before the previous pulse period are input into the subtraction circuit. The subtraction circuit calculates the difference between these counter values by subtracting the counter value corresponding to the pulse period immediately before the previous pulse period from the counter value corresponding to the previous pulse period, and outputs this difference value to the addition circuit. As a result, every time the edge detection circuit generates a pulse signal, the counter value corresponding to the previous pulse period and the value for the difference between the previous pulse period and the pulse period immediately before the previous pulse period are input into the addition circuit. The addition circuit adds these two values and outputs the result as a pulse period corresponding to the current movement speed of the moving member. The counter value output from the addition circuit is input into the timing pulse generating circuit. The timing pulse generating circuit divides the counter value by a prescribed value and issues the result as a timing pulse. This timing pulse is a timing signal that is an accurate estimation of the current velocity of the moving member. Hence, it is possible to execute prescribed operations with the moving member at a very precise timing.

It is preferable to use the timing pulse generator in an ink jet printer having a print head which corresponds to the moving member. The print head moves in the widthwise direction of a recording paper. The timing pulse generator further includes a print head driving control circuit that applies a timing to perform print operations with the print head based on the timing pulse generated by the timing pulse generator.

With this construction, it is possible to accurately estimate the pulse period corresponding to the current velocity of the print head and to increase printing quality for high resolution printing, even when the velocity of the print head varies subtly due to feedback control or mechanical factor in open control.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENT

A printing device having a timing pulse generator according to a preferred embodiment of the present invention will be described while referring to the accompanying drawings. The present embodiment relates to an ink-jet type serial printer, wherein the paper feeding mechanisms and the like are configured as those in ink-jet printers well-known in the art. Therefore, in the present embodiment, only components relevant to the print timing control of the serial printer will be described with reference to the diagrams.

Figure 1:
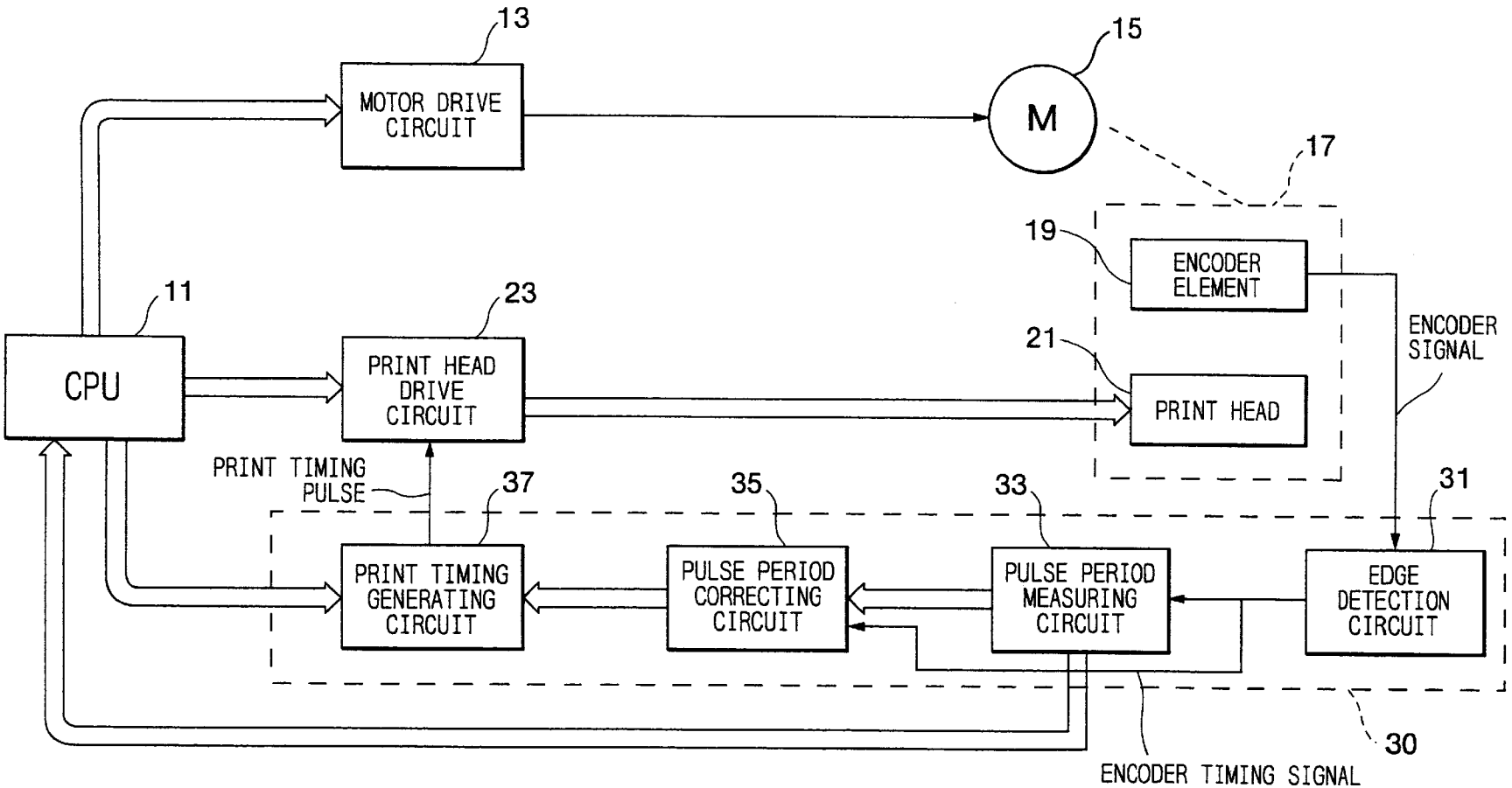
FIG. 1 is a block diagram showing the general structure of a print mechanism used in an ink-jet serial printer according to the embodiment.

As shown in FIG. 1, the printing mechanism of this ink-jet printer is provided with a CPU 11; a motor drive circuit 13 for outputting a motor drive signal in accordance with control signals received from the CPU 11; a DC motor 15 that is driven according to the motor drive signals output from the motor drive circuit 13; a carriage 17 that is driven by the DC motor 15 to move in the widthwise direction of the recording paper; an encoder element 19 provided in the carriage 17 for outputting an encoder signal that is inverted each time the carriage 17 moves a prescribed amount; an ink-jet type print head 21 also provided in the carriage 17; a print head drive circuit 23 that receives control signals from the CPU 11 and provides drives signals to the print head 21; and a timing pulse generator 30 that is an ASIC for outputting print timing pulses to the drive circuit 23 based on the encoder signal output from the encoder element 19. The main components of the timing pulse generator 30 include an edge detection circuit 31, a pulse period measuring circuit 33, a pulse period correcting circuit 35, and a print timing generating circuit 37.

In accordance with print data and resolution settings input from a personal computer or the like, the CPU 11 outputs control signals to the motor drive circuit 13, drive circuit 23, and print timing generating circuit 37, based on the pulse period measured by the pulse period measuring circuit 33. The CPU 11 increases or decreases the control signals output to the motor drive circuit 13 using feedback control, in order to move the carriage 17 at the target speed.

Based on print data input from the CPU 11 and timing pulse signals input from the print timing generating circuit 37, the drive circuit 23 outputs drive signals for ejecting ink from the various ink-jet nozzles of the print head 21 in order to conform to the prescribed resolution.

Figure 3:
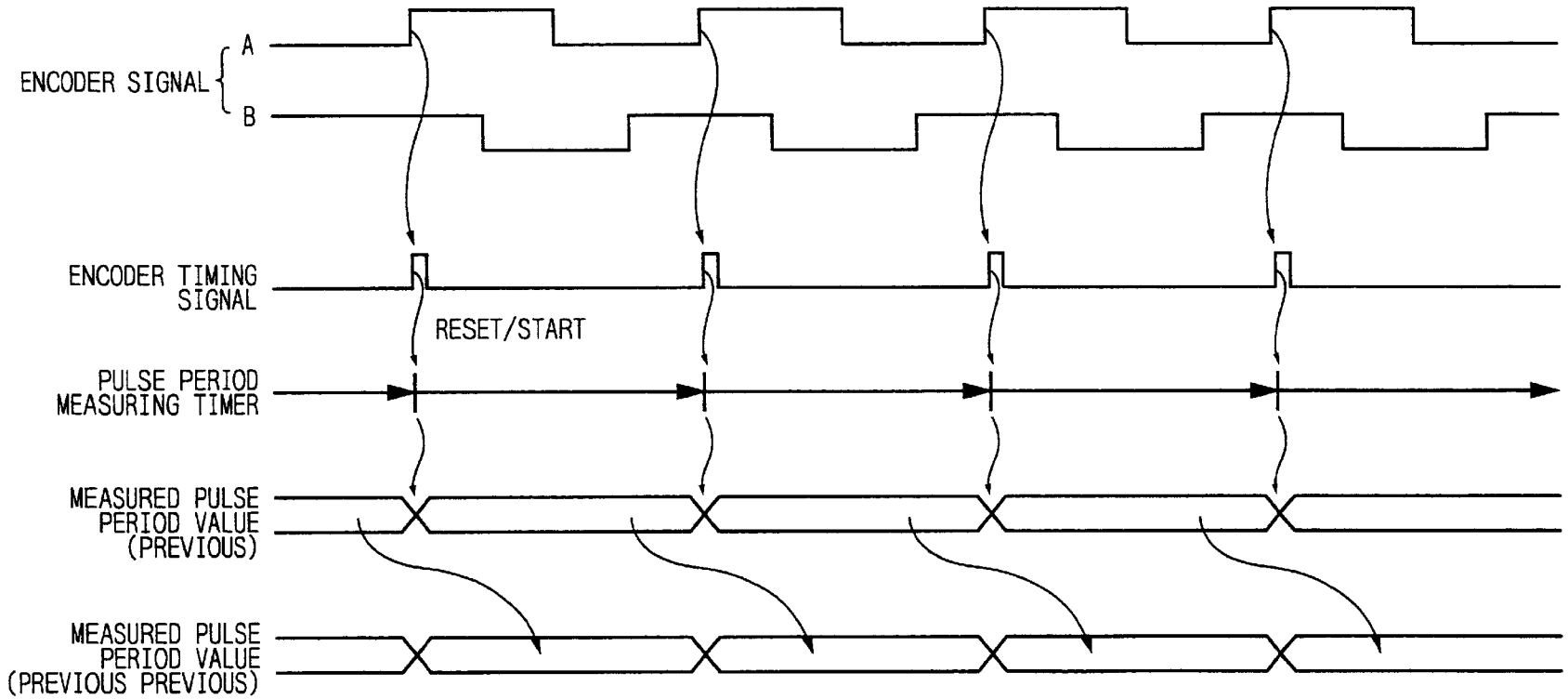
FIG. 3 is a timing chart showing the process for measuring a pulse period in the present embodiment.

As shown in FIG. 3, the encoder element 19 outputs encoder signals at two different phases: an A phase and a B phase. Two different encoder phases are output to enable the moving direction of the carriage 17 to be distinguished from the phase difference, the same reason they are employed in various serial printers well-known in the art. In the present embodiment, print timing control and feedback control of the DC motor 15 are executed based on the A phase encoder signal.

As shown in the second line of FIG. 3, the A phase encoder signal is input into the edge detection circuit 31, which is configured to detect the rising edge of this encoder signal and to output an encoder timing signal (pulse signal). As shown in FIG. 1, this encoder timing signal is input into the pulse period measuring circuit 33 and the pulse period correcting circuit 35.

Figure 2:
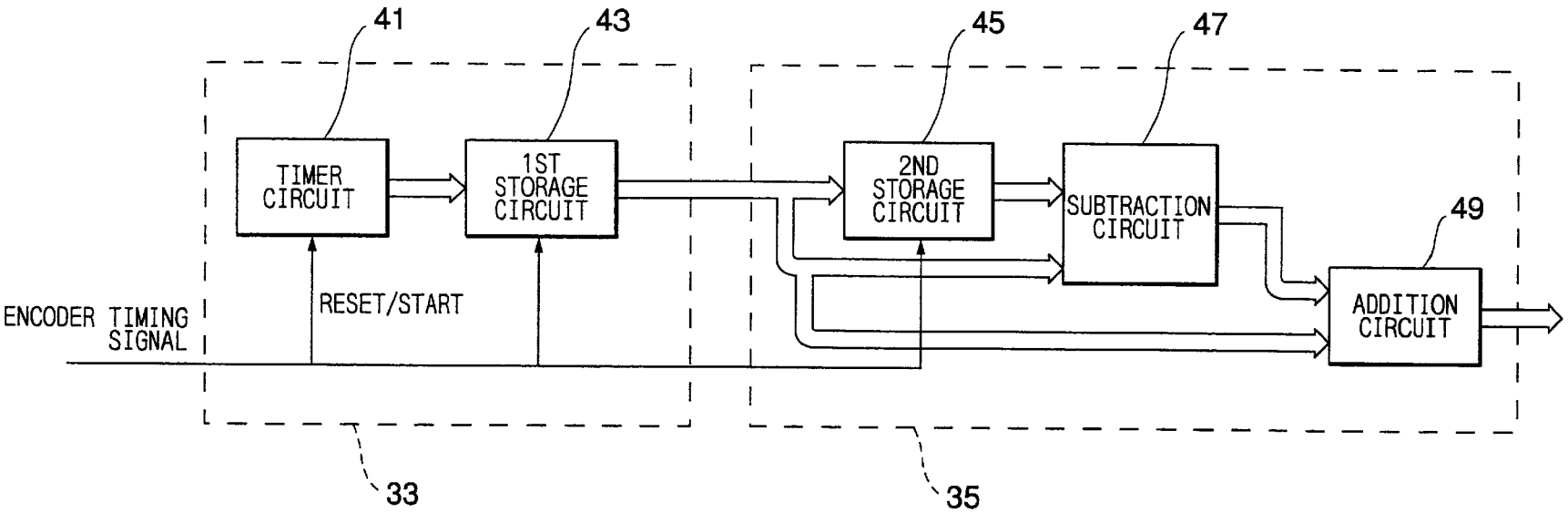
FIG. 2 is a block diagram showing the structures of a pulse period measuring circuit and a pulse period correcting circuit used in the timing pulse generator of the embodiment.

As shown in FIG. 2, the pulse period measuring circuit 33 is provided with a timer circuit 41 that resets and when an encoder timing signal is input from the edge detection circuit 31, and also outputs the counter value stored up to that point; and a first storage circuit 43 that resets when an encoder timing signal is input from the edge detection circuit 31, outputs the counter value stored up to that point, and stores the new counter value input from the timer circuit 41.

The pulse period correcting circuit 35 is provided with a second storage circuit 45 that resets according to the encoder timing signal output from the edge detection circuit 31, outputs the counter value stored up to that point, and overwrites the storage contents with the counter value output from the first storage circuit 43; a subtraction circuit 47 that receives the counter values output from the first storage circuit 43 and second storage circuit 45 and outputs the difference calculated by subtracting the counter value output by the second storage circuit 45 from the counter value output from the first storage circuit 43; and an addition circuit 49 that receives the difference value output from the subtraction circuit 47 and the counter value output from the first storage circuit 43 and outputs the sum of the two values. The value output from the addition circuit 49 is input into the print timing generating circuit 37. The counter value output from the first storage circuit 43 in response to the input of the encoder timing signal corresponds to the previous pulse period, whereas the counter value output from the second storage circuit 45 corresponds to the pulse period immediately before the previous pulse period. As shown in is FIG. 1, the previous pulse period output from the first storage circuit 43 is input into the CPU 11 from the pulse period measuring circuit 33 as the measured pulse period value and is used for feedback control of the DC motor 15. In addition, the first storage circuit 43 and second storage circuit 45 employ flip-flop circuits.

FIG. 3 is a timing chart for the process described above. Based on the encoder signals output from the carriage 17, encoder timing signals are generated by the edge detection circuit 31. Here, these encoder timing signals act as reset/start signals for repeatedly executing pulse period measurements by the timer circuit 41. At each reset/start signal, the previous measured pulse period value is transferred from the first storage circuit 43 to the second storage circuit 45, thereby enabling storage of the previous pulse period and the pulse period immediately before this previous pulse period.

With the timing pulse generator 30 of the present embodiment provided in the serial printer, encoder signals are output from the encoder element 19 when the DC motor 15 moves the carriage 17. These encoder signals change (invert) each time the carriage moves a prescribed amount. The edge detection circuit 31 outputs an encoder timing signal (pulse signal) each time a rising edge of this encoder signal is detected. The pulse signal output from the edge detection circuit 31 is used as a reset signal for the timer circuit 41, first storage circuit 43, and second storage circuit 45.

When a pulse signal is output from the edge detection circuit 31, the timer circuit 41 is reset and started. Here, the timer circuit 41 outputs the counter value it has accumulated thus far to the first storage circuit 43 as the measured pulse period value. When a pulse signal output from the edge detection circuit 31 is input as a reset signal into the first storage circuit 43, the first storage circuit 43 outputs the previous measured pulse period value input from the timer circuit 41 and stored in the first storage circuit 43, and rewrites the storage area with the new measured pulse period value input from the timer circuit 41. In this way, the measured value for the previous pulse period that was output from the first storage circuit 43 is input into the second storage circuit 45, subtraction circuit 47, and addition circuit 49.

When a pulse signal is output from the edge detection circuit 31 to the second storage circuit 45 as a reset signal, the second storage circuit 45 outputs the measured pulse period value input from the first storage circuit 43 and stored up to that point as the pulse period immediately before the previous pulse period value, and overwrites the storage area with the new previous measured pulse period value output from the first storage circuit 43. At this time, the pulse period immediately before the previous measured pulse period value output from the second storage circuit 45 is input into the subtraction circuit 47. In this way, each time the edge detection circuit 31 generates a pulse signal, the previous measured pulse period value and the pulse period value immediately before the previous measured pulse period value are input into the subtraction circuit 47 from the first storage circuit 43 and the second storage circuit 45.

The subtraction circuit 47 calculates the difference between the two values by subtracting the pulse period value immediately before the previous measured pulse period value from the previous measured pulse period value and outputs this difference value to the addition circuit 49. Hence, each time the edge detection circuit 31 generates a pulse signal, the previous measured pulse period value and the difference value between the previous measured pulse period value and the pulse period value immediately before the previous measured pulse period value are input into the addition circuit 49. The addition circuit 49 adds these two values and outputs the result as the estimated pulse period value corresponding to the current velocity of the carriage 17.

This estimated pulse period value output from the addition circuit 49 is input into the print timing generating circuit 37. The print timing generating circuit 37 divides the value according to the resolution indicated by the CPU 11. Next, a print timing pulse is output to the drive circuit 23 at the interval determined by this division result.

Figure 4A:
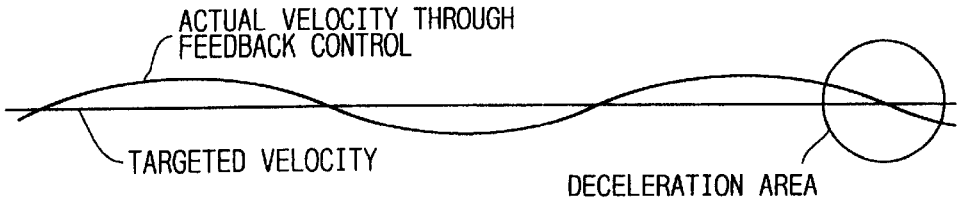
FIG. 4(A) is a graph showing the targeted and actual velocity of the carriage.
Figure 4B:
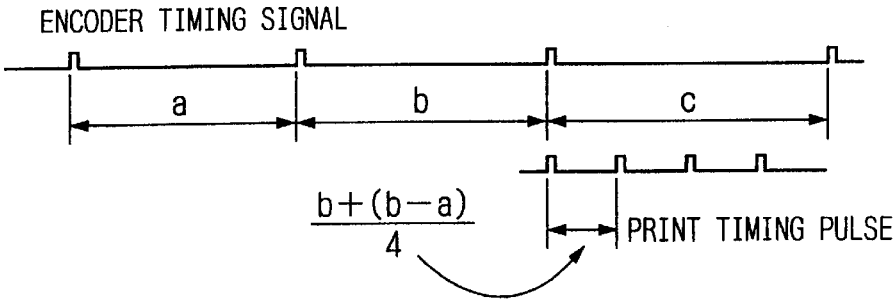
FIG. 4(B) is a timing chart showing an example of a print timing pulse output in the present embodiment.
Figure 5A:
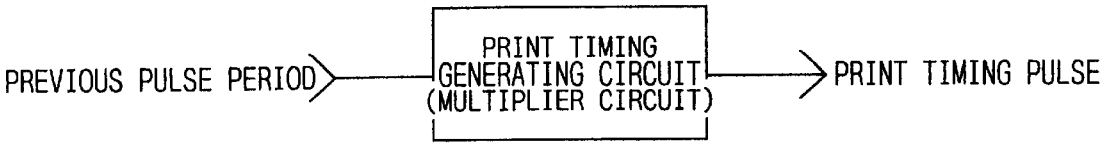
FIG. 5(a) PRIOR ART
FIG. 5(A) is a block diagram showing the general structure of a conventional print timing generator.
Figure 5B:
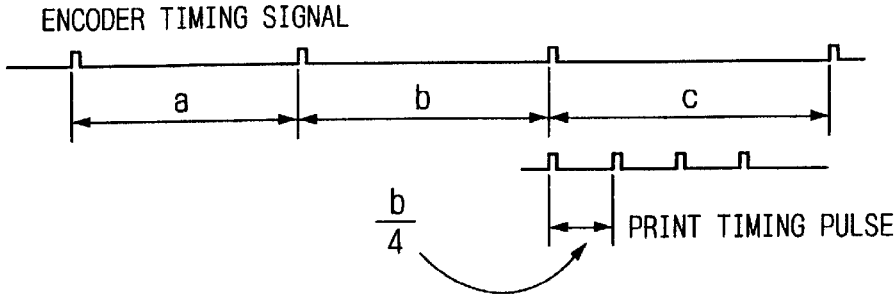
FIG. 5(b) PRIOR ART
FIG. 5(B) is a timing chart showing an example of a print timing pulse output in a conventional device.

FIG. 4(A) shows how the velocity of the carriage 17 varies in relation to the target speed due to feedback control. FIG. 4(B) shows how a larger encoder timing signal interval is output when the actual velocity of the carriage 17 is in an area of deceleration due to variations caused by feedback control. In this example, the difference value calculated by subtracting the pulse period value immediately before the previous pulse period A from the previous pulse period B is added to the previous pulse period B to obtain a corrected value. This corrected value is divided by 4 in this example, based on the resolution indicated by the CPU 11. The result is output as the print timing pulse. As shown in FIG. 4(A), when performing feedback control for the velocity of the carriage 17, there are no abrupt variations in speed, but rather gradual and uniform acceleration and deceleration trends. From this data, it can be seen that the current actual pulse period C approximately conforms to B+(B−A). Therefore, the print timing pulse is output at a timing in which the current pulse period C is divided fairly accurately into four equal parts, enabling the pint timing to be controlled with a high degree of accuracy.

While the invention has been described in detail with reference to specific embodiments thereof, it would be apparent to those skilled in the art that many modifications and variations may be made therein without departing from the spirit of the invention, the scope of which is defined by the attached claims.

For example, it is possible to achieve high quality printing at a high accuracy by providing the timing pulse generator 30 described above in a serial printer that performs printing using an open control method accomplished with a stepping motor, rather than using the feedback control method. Further, the present invention is not limited to ink-jet style printers. The timing pulse generator of the present invention can also be applied to dot impact type serial printers. Further, it is possible to estimate a pulse period corresponding to the current velocity of the carriage 17 by saving not only the previous pulse period and the pulse period immediately before the previous pulse period, but also pulse period data further in the past, and by considering the variations in all these saved pulse periods.

With the timing pulse generator described above, it is possible to generator a highly accurate timing pulse that accounts for variations in speed of the moving member. It is further possible to control with high accuracy the timing for executing prescribed operations with the moving member.

With the timing pulse generator described above, simple logic circuit structures capable of rapid processing are suitable for storing the previous pulse period and the pulse period immediately before the previous pulse period necessary for implementing the present invention.

What is claimed is:

1. A timing pulse generator for generating timing pulse in association with movement of a moving member that is driven to move at a velocity along a prescribed transport path, the timing pulse generator comprising:

a pulse generating circuit that generates pulse signals corresponding to the velocity of the moving member;

a timer circuit that sequentially measures pulse periods between two succeedingly occurring pulse signals generated by said pulse generating circuit;

a storage circuit that stores a previous pulse period previously measured by said timer circuit and a pulse period immediately before the previous pulse period measured by said timer circuit immediately before the measurement of the previous pulse period;

a pulse period estimating circuit that estimates a pulse period corresponding to a current velocity of the moving member based on the previous pulse period and the pulse period immediately before the previous pulse period; and a timing pulse generating circuit that generates timing pulses based on the pulse period estimated by said pulse period estimating circuit in order to provide timings for executing prescribed operations with the moving member.

2. The timing pulse generator according to claim 1, wherein said storage circuit comprises a first storage circuit that stores the previous pulse period, and a second storage circuit that stores the pulse period immediately before the previous pulse period.

3. The timing pulse generator according to claim 2, wherein said pulse generating circuit comprises an encoder element that outputs an encoder signal having a level varied according to an amount of movement by the moving member, and an edge detection circuit that receives the encoder signal from said encoder element and outputs the pulse signals when an edge indicating a change in the level of the encoder signal is detected.

4. The timing pulse generator according to claim 3, wherein said encoder element is mounted on the moving member so as to move with the moving member and outputs the encoder signal that is inverted each time the moving member moves a predetermined amount.

5. The timing pulse generator according to claim 3, wherein said encoder element is mounted on the moving member that reciprocally moves back and forth, said encoder element outputting encoder signals at two different phases to enable a moving direction of the moving member to be distinguished from a phase difference of the encoder signals.

6. The timing pulse generator according to claim 3, wherein said edge detection circuit, said timer circuit, said pulse signal estimating circuit, and said timing pulse generating circuit are formed by an application specified integrated circuit.

7. The timing pulse generator according to claim 6, wherein said timing pulse generating circuit generates the timing pulse by dividing the estimated pulse period by a prescribed value.

8. The timing pulse generator according to claim 3, wherein said timer circuit resets and restarts measuring the pulse periods when the pulse signals are input from said edge detection circuit, the pulse period measured by said timer circuit up to a time when said timer circuit has reset being overwritten in said first storage circuit, a pulse period stored in said first storage circuit up to the time when said timer circuit has reset being overwritten in said second storage circuit.

9. The timing pulse generator according to claim 2, wherein said pulse period estimating circuit comprises a subtracting circuit that calculates a value by subtracting the pulse period immediately before the previous pulse period from the previous pulse period; and an adding circuit that adds the value calculated by said subtracting circuit to the previous pulse period stored in the first storage circuit to provide an estimated pulse period.

10. The timing pulse generator according to claim 9, wherein said timing pulse generating circuit generates the timing pulse by dividing the estimated pulse period by a value representative of a resolution.

11. The timing pulse generator according to claim 1, wherein said pulse period estimating circuit estimates the pulse period corresponding to the current velocity of said moving member based on a difference between the previous pulse period and the pulse period immediately before the previous pulse period.

12. A timing pulse generator comprising:

an encoder element that outputs an encoder signal having a level varied according to an amount of movement by a moving member;

an edge detection circuit that receives the encoder signal from said encoder element and outputs a pulse signal when an edge indicating a change in the level is detected;

a timer circuit that outputs an accumulated counter value and resets and starts itself based on the pulse signal output by said edge detection circuit;

a first storage circuit that outputs a currently stored counter value and resets itself based on the pulse signal output by said edge detection circuit and that overwrites storage contents with the counter value output from said timer circuit;

a second storage circuit that outputs a currently stored counter value and resets itself based on the pulse signal output by said edge detection circuit and that overwrites storage contents with the counter value output from said first storage circuit;

a subtraction circuit that receives as input the counter values output from said first storage circuit and said second storage circuit and that outputs a difference value calculated by subtracting the counter value output from said second storage circuit from the counter value output from said first storage circuit;

an addition circuit that receives as input the difference value output from said subtraction circuit and the counter value output from said first storage circuit and that outputs a counter value calculated by adding these two values; and a timing pulse generating circuit that generates a timing pulse to apply a timing to the moving member in order to execute prescribed operations.

13. An ink jet printer comprising:

a carriage reciprocally moving at a velocity back and forth along a widthwise direction of a recording paper;

a print head mounted on said carriage so as to move with said carriage;

a print head driving circuit for driving said print head;

a pulse generating circuit that generates pulse signals corresponding to the velocity of said carriage;

a timer circuit that sequentially measures pulse periods between two succeedingly occurring pulse signals generated by said pulse generating circuit;

a storage circuit that stores a previous pulse period previously measured by said timer circuit and a pulse period immediately before the previous pulse period measured by said timer circuit immediately before the measurement of the previous pulse period;

a pulse period estimating circuit that estimates a pulse period corresponding to a current velocity of said carriage based on the previous pulse period and the pulse period immediately before the previous pulse period; and a print timing pulse generating circuit that generates print timing pulses based on the pulse period estimated by said pulse period estimating circuit, the print timing pulses being applied to said print head driving circuit for executing printing operations with said print head.

14. The ink jet printer according to claim 13, wherein said storage circuit comprises a first storage circuit that stores the previous pulse period, and a second storage circuit that stores the pulse period immediately before the previous pulse period.

15. The ink jet printer according to claim 14, wherein said pulse generating circuit comprises an encoder element that outputs an encoder signal having a level varied according to an amount of movement by said carriage, and an edge detection circuit that receives the encoder signal from said encoder element and outputs the pulse signals when an edge indicating a change in the level of the encoder signal is detected.

16. The ink jet printer according to claim 15, wherein said encoder element is mounted on said carriage so as to move with said carriage and outputs the encoder signal that is inverted each time said carriage moves a predetermined amount.

17. The ink jet printer according to claim 15, wherein said encoder element is mounted on said carriage that reciprocally moves back and forth, said encoder element outputting encoder signals at two different phases to enable a moving direction of said carriage to be distinguished from a phase difference of the encoder signals.

18. The ink jet printer according to claim 15, wherein said edge detection circuit, said timer circuit, said pulse signal estimating circuit, and said print timing pulse generating circuit are formed by an application specified integrated circuit.

19. The ink jet printer according to claim 18, wherein said timing pulse generating circuit generates the timing pulse by dividing the estimated pulse period by a value representative of a resolution.

20. The ink jet printer according to claim 15, wherein said timer circuit resets and restarts measuring the pulse periods when the pulse signals are input from said edge detection circuit, the pulse period measured by said timer circuit up to a time when said timer circuit has reset being overwritten in said first storage circuit, a pulse period stored in said first storage circuit up to the time when said timer circuit has reset being overwritten in said second storage circuit.

21. The ink jet printer according to claim 14, wherein said pulse period estimating circuit comprises a subtracting circuit that calculates a value by subtracting the pulse period immediately before the previous pulse period from the previous pulse period; and an adding circuit that adds the value calculated by said subtracting circuit to the previous pulse period stored in the first storage circuit to provide an estimated pulse period.

22. The ink jet printer according to claim 21, wherein said timing pulse generating circuit generates the timing pulse by dividing the estimated pulse period by a value representative of a resolution.

23. The ink jet printer according to claim 13, wherein said pulse period estimating circuit estimates the pulse period corresponding to the current velocity of said carriage based on a difference between the previous pulse period and the pulse period immediately before the previous pulse period.

24. A timing pulse generator for generating timing pulses in association with movement of a moving member that is driven to move at a velocity along a prescribed transport path, the timing pulse generator comprising;

a pulse generating circuit that generates pulse signals corresponding to the velocity of the moving member;

a timer circuit that sequentially measures at least two pulse periods each between two succeedingly occurring pulse signals generated by said pulse generating circuit;

a storage circuit that stores at least a previous pulse period previously measured by said timer circuit and a pulse period immediately before the previous pulse period measured by said timer circuit immediately before the measurement of the previous pulse period;

a pulse period estimating circuit that estimates a pulse period corresponding to a current velocity of the moving member based at least on the previous pulse period and the pulse period immediately before the previous pulse period; and a timing pulse generating circuit that generates timing pulses based on the pulse period estimated by said pulse period estimating circuit in order to provide timings for executing prescribed operations with the moving member.

25. The timing pulse generator according to claim 24, wherein said timing pulse generating circuit generates the timing pulse by dividing the estimated pulse period by a value representative of a resolution.

* * * * *